US009265349B1

(12) United States Patent
Jensen

(10) Patent No.: US 9,265,349 B1
(45) Date of Patent: Feb. 23, 2016

(54) MULTI-DIRECTIONAL AND SIDE GLIDER CHAIR

(71) Applicant: Valerie Jensen, Wrangell, AK (US)

(72) Inventor: Valerie Jensen, Wrangell, AK (US)

( * ) Notice: Subject to any disclaimer, the term of this patent is extended or adjusted under 35 U.S.C. 154(b) by 0 days.

(21) Appl. No.: 14/543,858

(22) Filed: Nov. 17, 2014

Related U.S. Application Data

(60) Provisional application No. 61/953,863, filed on Mar. 16, 2014.

(51) Int. Cl.
*A47C 3/02* (2006.01)
*A47C 3/18* (2006.01)
*A47C 3/025* (2006.01)

(52) U.S. Cl.
CPC ..... *A47C 3/18* (2013.01); *A47C 3/0255* (2013.01)

(58) Field of Classification Search
CPC ..... A47C 3/025; A47C 3/0255; A47C 3/18
USPC ..... 297/273, 281, 314, 344.22, 344.21, 297/344.26
See application file for complete search history.

(56) References Cited

U.S. PATENT DOCUMENTS 30,706 A * 11/1860 Van Vleck ..... 297/314
3,697,131 A * 10/1972 Thompson ..... 297/263.1
4,796,949 A 1/1989 Boyce
5,113,851 A * 5/1992 Gamba ..... 297/330
5,344,214 A 9/1994 Trent
5,395,157 A * 3/1995 Rollo et al. ..... 297/344.26
5,409,295 A * 4/1995 Edstrom ..... 297/314
5,588,704 A * 12/1996 Harza ..... 297/314
5,630,646 A * 5/1997 Trimble ..... 297/281
6,106,062 A 8/2000 Ambrose, Jr. et al.
D460,632 S 7/2002 Brooks
6,464,295 B1 * 10/2002 Bergeron et al. ..... 297/270.4
D525,442 S 7/2006 Pomeroy et al.
7,100,983 B1 * 9/2006 Gant ..... 297/314
D547,075 S 7/2007 Stilwell et al.
7,434,863 B2 * 10/2008 Hamazaki et al. ..... 297/344.21

* cited by examiner

*Primary Examiner* — Peter Brown
(74) *Attorney, Agent, or Firm* — Bold IP, PLLC

(57) ABSTRACT

A multi-directional glider chair allowing for rotation of a seat in relation to a path of gliding action. In some embodiments, the multi-directional glider comprises a glider base including a glider mechanism supporting a gliding top, the glider mechanism providing for generally linear motion of the gliding top along at least a segment of a first axis, and a seat including at least a bottom element, the bottom element being rotatably coupled to the gliding top of the glider base by a rotatable coupler providing for rotation of the seat about a second axis, wherein an orientation of the seat in relation to the first axis may be selectively modified by rotation of the seat about the second axis. Thus, the multi-directional glider as described in this embodiment enables a user to modify an orientation of the seat in relation to a back-and-forth glide path allowed by the glider mechanism.

10 Claims, 15 Drawing Sheets

MULTI-DIRECTIONAL AND SIDE GLIDER CHAIR

CROSS-REFERENCE TO RELATED APPLICATIONS

The present application claims the benefit of U.S. Provisional Patent Application No. 61/953,863 which was filed on Mar. 16, 2014, entitled "Multi Directional Glider and Side Glider," which is incorporated herein by reference in their entirety as if fully set forth herein.

FIELD OF THE DISCLOSURE

The present disclosure relates generally to the field of glider type rocking chairs and, more particularly, to a glider type rocking chair allowing for rotation of a seat portion of the chair in relation to a path of the gliding action.

BACKGROUND

This section provides background information related to the present disclosure which is not necessarily prior art.

Glider chairs are well known in the art. Various Patents and Published patent applications are in fact directed to glider chairs. While developing the invention of the instant application independently the Inventor researched extensively the public record as well as the current market for rocking chair, gliders, swingers, and the like. The most relevant examples found in the search are mentioned in the Information Disclosure Statement (IDS) attached.

One potential application of the multi-directional glider disclosed herein relates to assisting babies to sleep through swaying motion. Sleep is crucial to a baby's health and well-being as newborns require as much as 16 hours of sleep per day, and one year olds need up to 14 hours. Babies sleep is also important for the parents since this is the only time they have to recover. Most babies go through periods of fussiness which can be caused by multiple factors. The challenge for caregivers and parents during these times is finding a solution that will enable them to sustainably soothe and comfort baby. A fussy baby and physically exhausted, sleep deprived parents can and often does result in miserable nights where nobody gets enough sleep to recover.

There is no final and definitive way to induce a baby to rest, although traditionally a rocking chair has been a relatively well established and proven solution. Babies tend to fall asleep while in motion, but commercially available rocker and glider chairs only allow the option to swing front-to-rear thus limiting the range of movement that can be offered to the baby. However, some babies may in fact relax better with a sideways motion swinging from the left to the right or vice versa from the right to the left. The motion limitation of traditional rocking chair is due to various possible facts mainly related to the difficulty to build a sideways sliding mechanism.

Therefore there is the need in the art for a chair that glides from side-to-side rather than fore-to-aft.

SUMMARY

This section provides a general summary of the disclosure, and it is not a comprehensive disclosure of its full scope or all of its features.

A glider type rocking chair allowing for rotation of a seat portion of the chair in relation to a path of the gliding action thereby providing for a plurality of glide paths in relation to a seated persons orientation, a.k.a. a multi-directional glider, is disclosed herein. In some embodiments, the multidirectional glider comprises a glider base including a glider mechanism supporting a gliding top, the glider mechanism providing for generally linear motion of the gliding top along at least a segment of a first axis, and a seat including at least a bottom element, the bottom element being rotatably coupled to the gliding top of the glider base by a rotatable coupler providing for rotation of the seat about a second axis, wherein an orientation of the seat in relation to the first axis may be selectively modified by rotation of the seat about the second axis. Thus, the multi-directional glider as described in this embodiment enables a user to modify an orientation of the seat in relation to a back-and-forth glide path allowed by the glider mechanism. For example, FIG. 1 illustrates a fore-and-aft glide path (e.g. a glide path within the sagittal plane of a seated person) whereas FIG. 2 illustrates a side-to-side glide path (e.g. a glide path within the coronal plane of a seated person).

Moreover, some embodiments comprise at least one locking mechanism configured for containing rotation of the seat about the second axis thereby constraining the orientation of the seat in relation to the first axis. Preferably, the locking mechanism is further configured for constraining the orientation of the seat in relation to the first axis at one or more predetermined orientations, e.g. the locking mechanism may include one or more detent systems.

The following embodiments and descriptions are for illustrative purposes only and are not intended to limit the scope of the multi-directional glider chair. Other aspects and advantages of the present disclosure will become apparent from the following detailed description.

BRIEF DESCRIPTION OF THE DRAWINGS

These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

The drawings included herein are considered by the applicant to be informal.

DETAILED DESCRIPTION

Following is a description by way of example only and with reference to the accompanying informal drawings of a manner of constructing and using the multi-directional glider. Example embodiments are provided to fully convey the scope of this disclosure to those skilled in the art. The present multi-directional glider may have additional embodiments, may be practiced without one or more of the details described for any particular described embodiment, or may have any detail described for one particular embodiment practiced with any other detail described for another embodiment. Numerous specific details are set forth as examples and are intended to provide a thorough understanding of embodiments of the present disclosure. It will apparent to one skilled in the art that these specific details need not be employed, that example embodiments may be embodied in many different forms, and that neither should be construed to limit the scope of the disclosure. In some example embodiments, well-known processes, well-known device structures, and well-known technologies are not described in detail.

Figure 1:
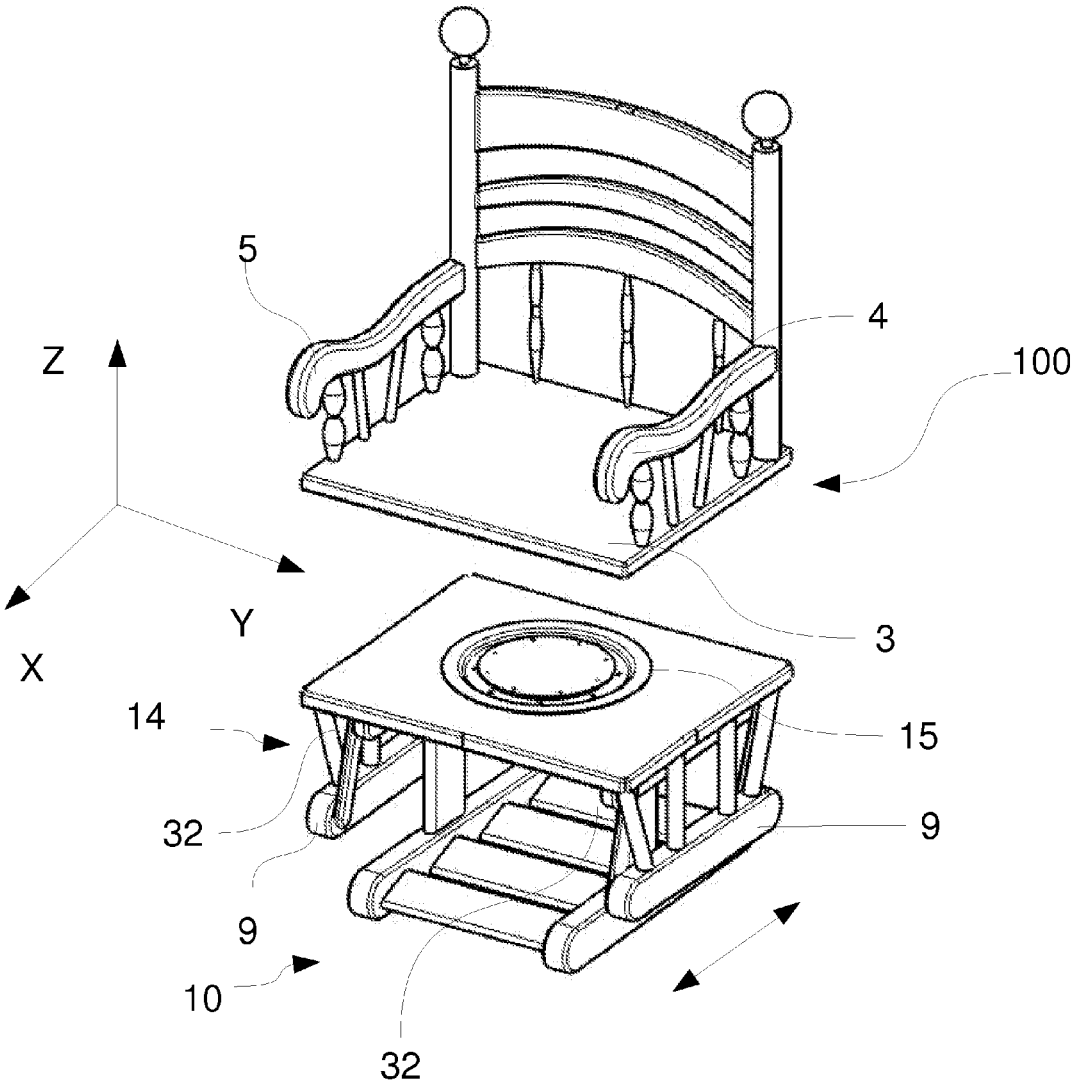
FIG. 1 shows a front perspective view of a multi-directional glider, wherein the view is partially exploded, in accordance with an embodiment of the present disclosure.
Figure 2:
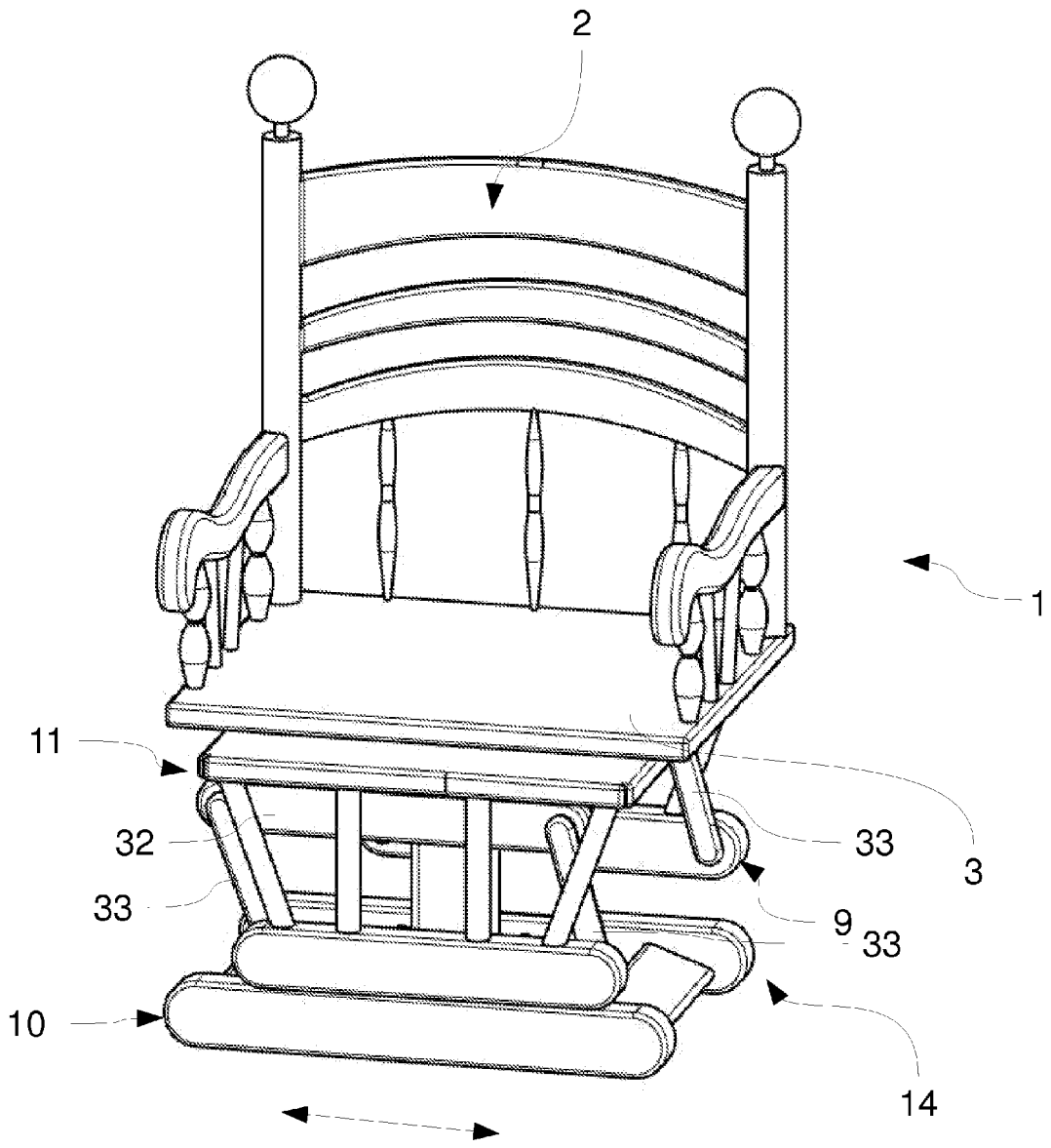
FIG. 2 shows a front perspective view of a multi-directional glider in accordance with an embodiment of the present disclosure.
Figure 3:
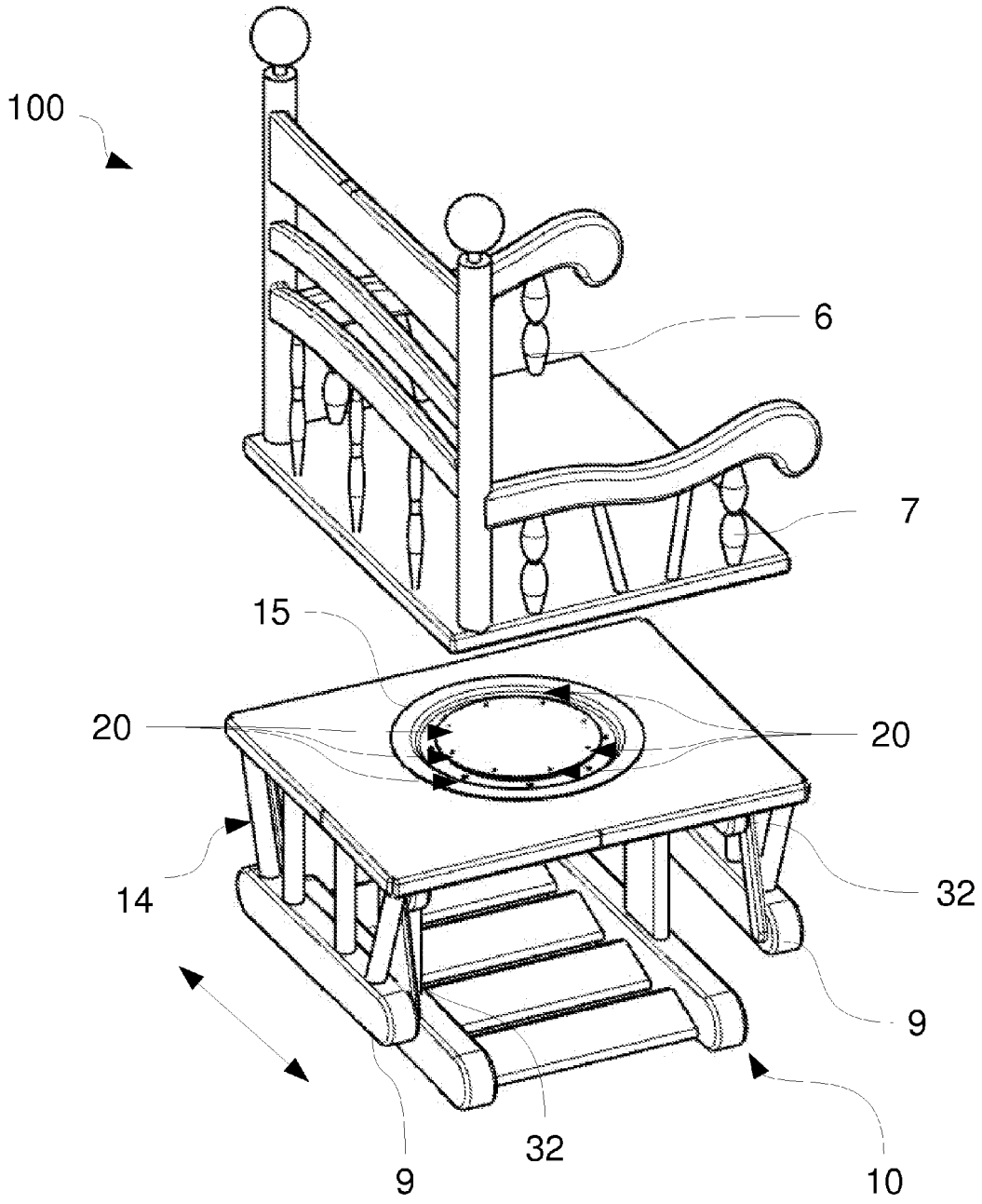
FIG. 3 shows a rear perspective view of a multi-directional glider, wherein the view is partially exploded, in accordance with an embodiment of the present disclosure.

Referring now to the drawings, FIGS. 1-3 show a various perspective views of a multi-directional glider 100 which allows for a user of the multi-directional glider to rotate a seat 1 in relation to a gliding base 14 which is configured to provide for a back and forth gliding motion as indicated in each of FIGS. 1-3 by the double-headed arrow. In a preferred embodiment, the seat 1 is rotatably coupled with the gliding base 14 with a rotatable coupler 15 (a bottom portion only of the rotatable coupler 15 is shown in FIGS. 1 and 3) such that the seat 1 may be freely rotated about an axis of rotation in relation to the gliding base 14. In some embodiments, the seat 1 is rotatably coupled to the gliding base 14 by way of a modern 360 degree locking swivel plate. In some embodiments, the seat 1 is rotatably coupled to the gliding base 14 by way of a "Lazy Susan" style turn-table bearing.

Referring particularly to FIG. 1, for example, one skilled in the art will recognize that the gliding base 14 is configured to provide for a smooth gliding motion back and forth motion along a first axis, e.g. the x-axis of the 3-dimential coordinate system indicated in FIG. 1. In some embodiments, the glider base 14 comprises at least one stationary horizontal support member 32 supported at a predetermined and appropriate distance above a base 10 wherein the base is intended to rest upon a floor, and at least one gliding horizontal support member 9 suspended from the at least one stationary horizontal support member 32, and a gliding top 11. One skilled in the art will appreciate that glider base 14 standing alone, i.e. without the seat 1 and rotatable coupler 15, generally resembles a typical gliding ottoman and functions similar to the same. However, as the glider base 14 is designed to support the entire weight of person, as opposed to merely supporting one's legs whilst seated, the glider base 14 will generally be larger in scale than a typical gliding ottoman.

Once again referring to FIGS. 1-3, in the illustrated embodiment the seat 1 resembles a top portion of a rocking chair in that it is comprised of a bottom element 3, a left and right armrest 4, 5 (respectively), each being supported by at least one armrest support 6, 7, and a backrest 2. The embodiment illustrated in FIGS. 1-3 is provided as an example only and many variations can be made regarding the configuration of the seat 1 without departing from the scope of the multi-directional glider 100 disclosed herein. For example, although not illustrated herein, one skilled in the art will appreciate that the glider base 10 and seat 1 may be configured such that the overall appearance of the multi-directional glider resembles a modern upholstered glider style chair such as is popular among persons furnishing a nursery. For example, the popular retail chain of BabiesRus® markets a variety of such upholstered gliders such as the KACY Collection Morgan Nursery Swivel Glider. Furthermore, the seat 1 of the multidirectional glider may, in accordance with certain embodiments, include one or more seat cushions (not shown) including but not limited to a lumbar support.

Referring in particular to FIGS. 1 and 2, due to the seat 1 being illustrated in an exploded position from the glider base 10, a bottom portion of the rotatable coupler 15 is exposed (the top portion of the rotatable coupler being affixed to the underside of the bottom element 3 of the seat. In some embodiments, each of the bottom and top portions of the rotatable coupler are fastened to the bottom element 3 of the seat and the gliding top 11 of the gliding base 10 respectively with mechanical fasteners 20. With reference to the 3-dimential coordinate system indicated in FIG. 1, it should be appreciated that due the bottom element 3 of the seat 1 being rotatably coupled to the gliding top 11 of the glider base 10 the entire seat 1, including features affixed to the seat such as the armrests 4, 5 and backrest 2 in the illustrated embodiment, is left unconstrained from rotation about the z-axis. Therefore, in a preferred embodiment, the seat 1 is constrained with regard to 4 degrees of freedom and unconstrained with regard to generally linear motion along the x-axis and also unconstrained with regard to rotational motion about the z-axis. As used herein, generally linear motion along an axis refers to purely linear motion as well as substantially linear motion such as that motion produced by a typical glider mechanism such as that depicted as the glider base 10. In particular, the gliding motion produced by the glider base 10 is represented by a small portion of a circular arc due to the at least one gliding horizontal support member 9 being suspended from the at least one stationary horizontal support member 32 by a one or more suspension members 33 wherein each suspension member is configured to pivot about an axis at each point where the suspension member 33 is affixed to each gliding horizontal support member 9 and each stationary horizontal support member 32. With regard to the use of the 3 dimensional coordinate system to describe the function of the multi-directional glider 100, the x-axis as used herein refers to a best fit type line of the glide path (represented by double headed arrows in selected views), and the y-axis refers is typically horizontal to the floor such that the y-axis is therefore perpendicular to the floor (although this is not necessarily the case in all embodiments). Furthermore, although it is within the scope of the present multi-directional glider for a variety of gliding mechanisms to be utilized, e.g. the glider mechanism may include near exact linear motion via inclusion of linear motion bearings configured to ride along a circular bar, preferred embodiments generally utilize a typical gliding mechanism used in a glider chair, i.e. a gliding mechanism comprising suspension members wherein the substantially linear motion is actual represented by an arc path, because such mechanisms are biased by gravity to a natural resting position.

Regarding the particular gliding motion a person seated in the multi-directional glider 100 will experience based on the particular orientation of the seat 1 with relation to the gliding base 10, FIG. 1 illustrates the seat 1 oriented such that a user seated in the seat 1 and initiating a gliding motion back and forth along the x-axis, e.g. back and forth as indicated by the direction of the double-headed arrow, will experience a front-to-back gliding motion; however, FIGS. 2 and 3 illustrate the seat 1 oriented such that a user seated in the seat 1 and initiating a gliding motion back and forth along the x-axis (represented by the double-headed arrow depicted in each of FIGS. 2 & 3) will experience a left-to-right (or side-to-side) gliding motion. Moreover, because preferred embodiments of the multi-directional glider 100 comprise a rotatable coupler 15 which provides for a full 360 degrees of rotation, a use of the multi-directional glider 100 is rotate the glide path in relation to the seat 1 along the full rotational spectrum of the z-axis, e.g. a user can glide along a glide path offset from left-to-right by 45 degrees.

Figure 4:
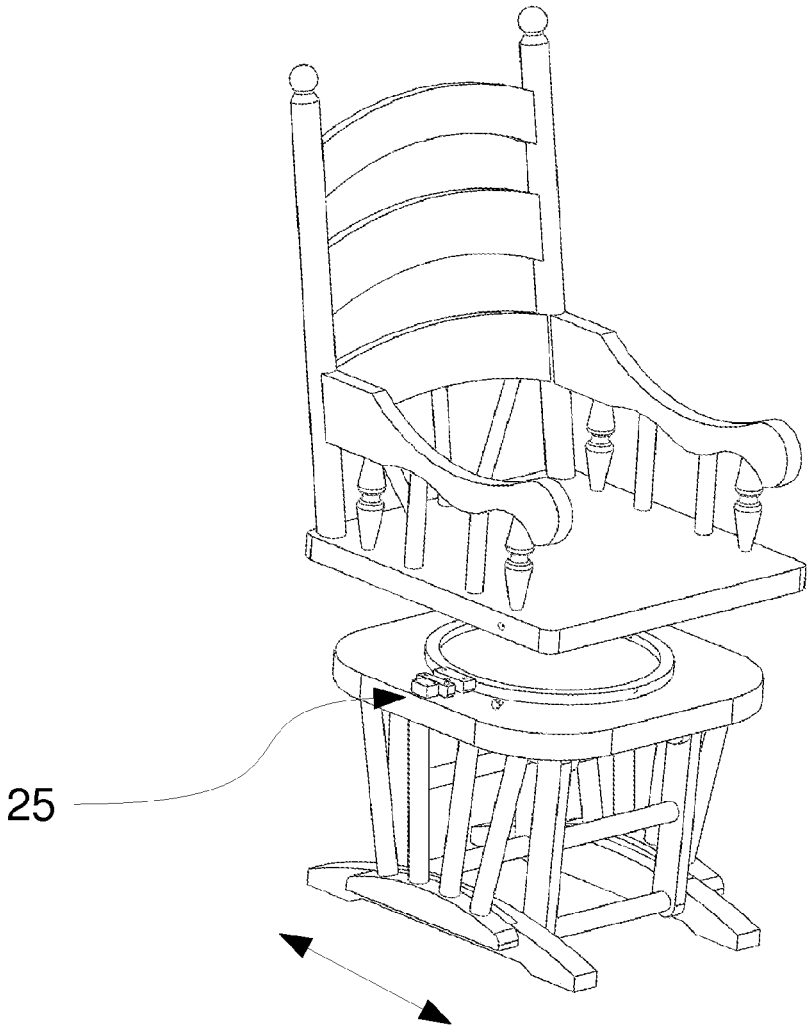
FIG. 4 shows a front perspective view of a multi-directional glider, wherein the view is partially exploded thereby exposing a locking mechanism, in accordance with an embodiment of the present disclosure.
Figure 5:
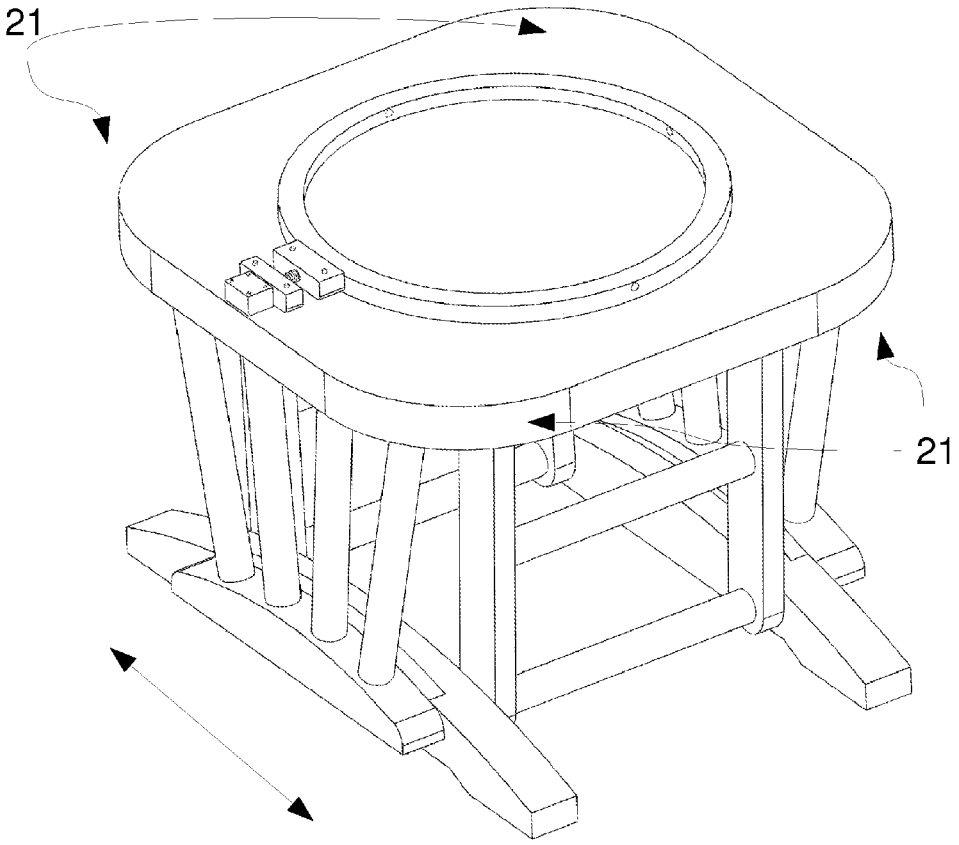
FIG. 5 shows a front perspective of a glider base of a multi-directional glider with a locking mechanism attached thereto, in accordance with an embodiment of the present disclosure.
Figure 6:
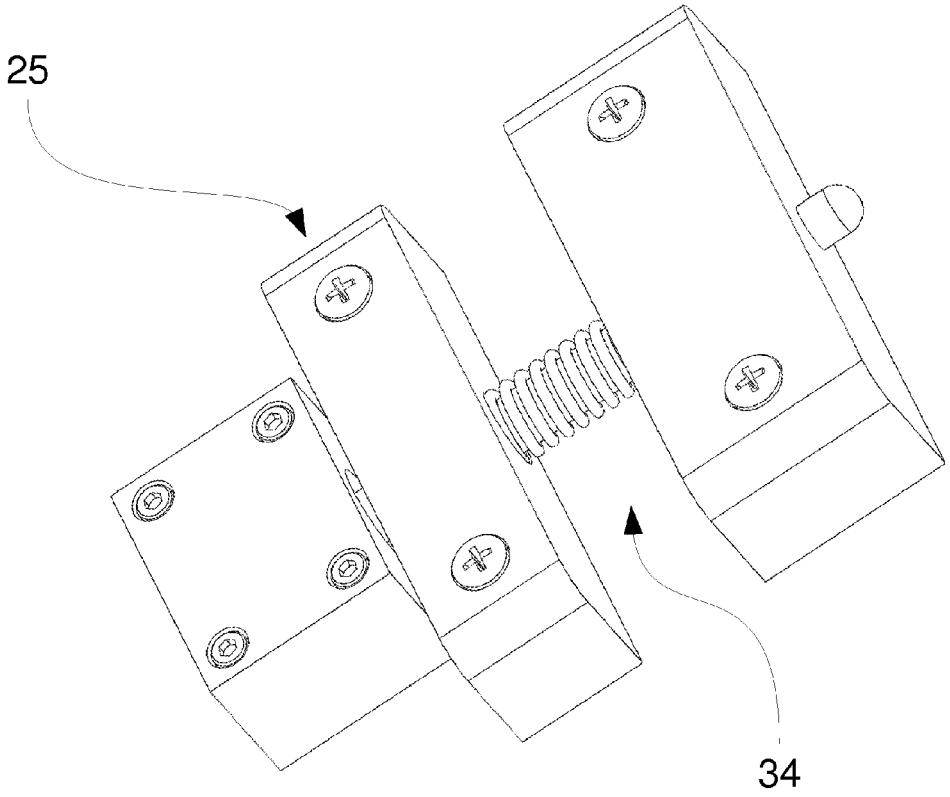
FIG. 6 shows a portion of a locking mechanism for locking an orientation of a seat in relation to a glide path of the multi-directional glider chair.
Figure 7:
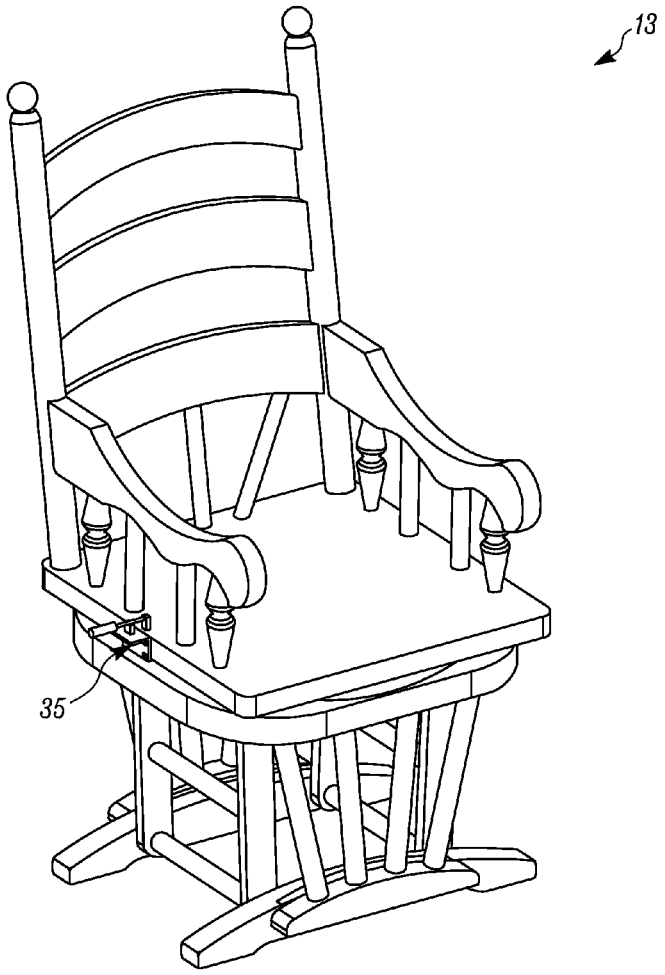
FIGS. 7-9 show various views of an embodiment of a multidirectional glider including a locking mechanism for locking an orientation of a seat of the multi-directional glider at any orientation about a rotational axis of the seat.
Figure 8:
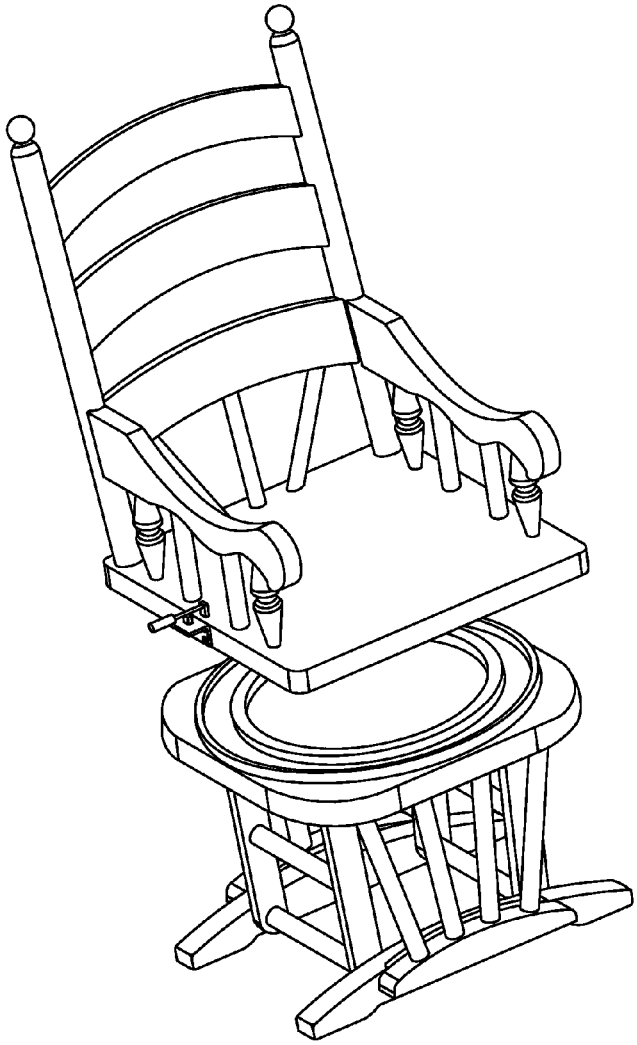
Figure 9:
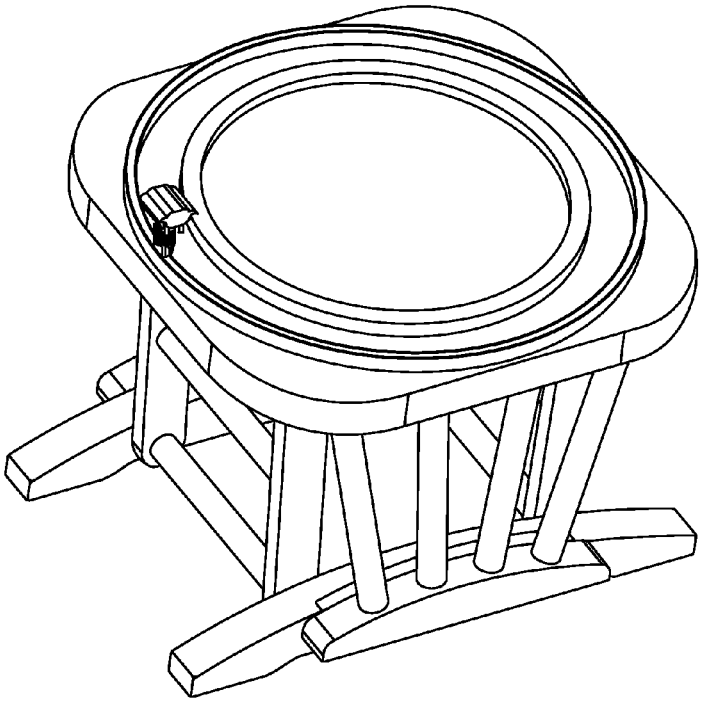

In preferred embodiments, the interface between the seat 1 and the gliding base 10 is configured to constrain rotation of the seat 1 about the axis of rotation of the rotabable coupler 15, e.g. a user is able to lock rotation about the z-axis of FIG. 1. In some embodiments, for example, the user is able to constraint the seat 1 in relation to the gliding base 10 at one or more predetermined orientations about the rotational axis of the rotatable coupler 15. For example, some embodiments may comprise four predetermined orientations wherein a first orientation configures the seat to glide back and forth along the x-axis with the user seated facing the positive x direction, a second orientation configured with the user facing the positive y direction, a third orientation configured with the user facing the negative x direction, and a fourth orientation configured with the user facing the negative y direction. In other embodiments, a user is able to constrain the seat 1 in relation to the gliding base 10 at any orientation about the entire range of 360 degree rotation about the z axis. With reference to FIGS. 4-9, for example, illustrate various embodiments of the multi-directional glider allowing for a user to lock the seat at any orientation. Referring particularly to FIGS. 4-6, in this embodiment a locking mechanism 25 is included on the glider base 10 and more particularly on the gliding top 11. A circular band (not shown) which is affixed to the underside of the seat 1 is sized appropriately to ride within an inside 34 of the locking mechanism 25 freely when the inside 34 is in widened position; however, the indie 34 of the locking mechanism may be decreased in size, i.e. the gap between the inner portion 35 and outer portion 36 is decreased such thereby applying a seizing force upon the circular band (not shown) affixed to the underside of the seat 1. As the locking mechanism of this particular embodiment is affixed to the gliding top 11 a user may have to get up from the seat 1 to reach and operate the locking mechanism 25. With reference to FIGS. 7-9, in some embodiments, a locking mechanism 35 is affixed onto, and therefore rotates with, the seat 1 thereby enabling the user to operate the locking mechanism 35 while remaining seated in the multi-directional glider 100. Such an embodiment is preferable as it allows the user to change the direction of gliding in relation to the direction the user is facing while remaining seated. One skilled in the art will immediately appreciate that there exists a multitude of options to achieve the ability to constrain the orientation of the seat 1 in relation to the glider base 10. As such, specific details regarding the means of containing the seat 1 in relation to the base 10 are omitted from the present specification.

Figure 10:
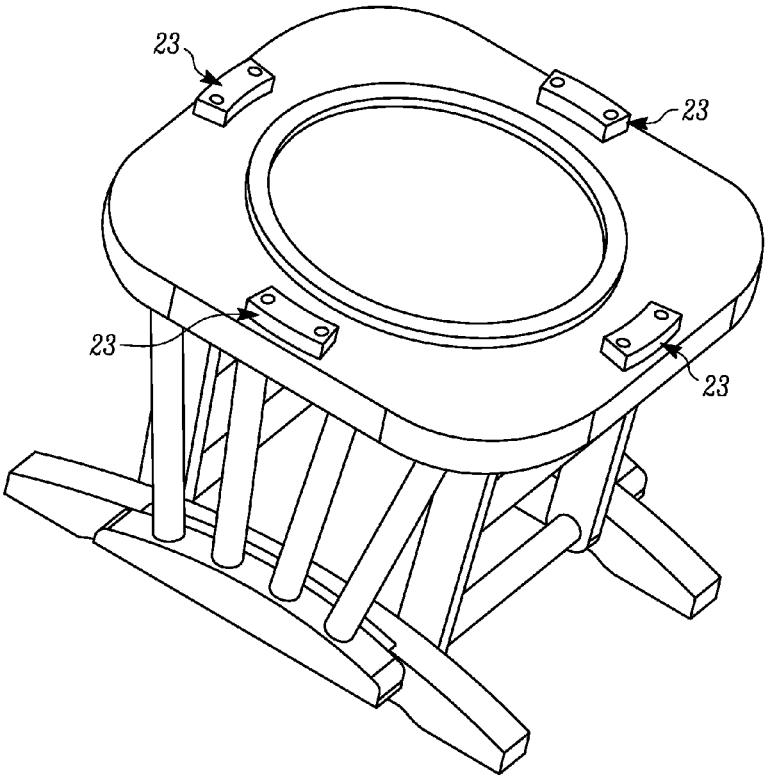
FIGS. 10-11 show various views of an embodiment of a multidirectional glider including a magnetic locking mechanism for locking an orientation of a seat of the multi-directional glider at any orientation about a rotational axis of the seat.
Figure 11:
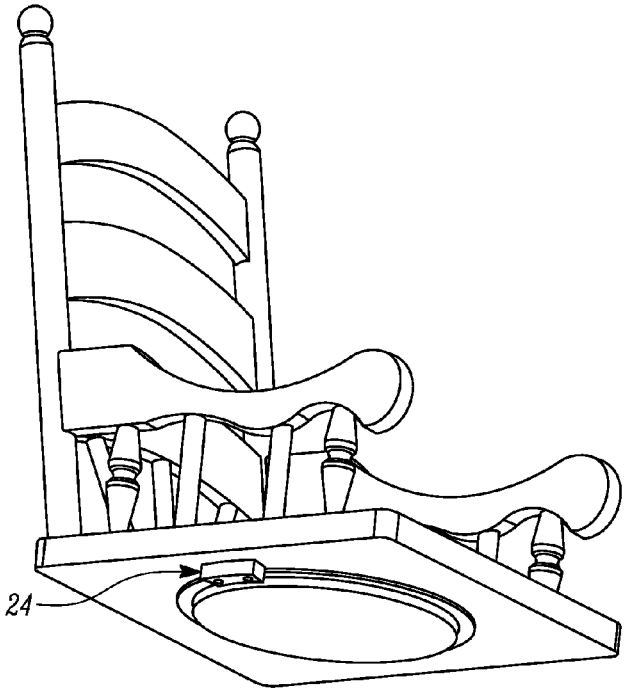

Referring now to FIGS. 10-11, in some embodiments the multi-directional glider 100 includes a magnetic locking mechanism comprising one or more base magnets 23 disposed at various predetermined orientations upon the gliding top 11 as well as one or more seat magnets 24 disposed upon the seat 1. For example, in some embodiments base magnets 23 are comprised of one or more neodymium magnets at four locations and the seat magnet 24 comprises a single neodymium magnet. Therefore, as the seat 1 is rotated about the z-axis an attractant force between the one or more base magnets 23 and the one or more seat magnets 24 causes the seat 1 to be constrained about the z-axis. However, in such embodiments a user is able to simply apply a moment of force great enough to overcome the attractant force thereby causing the seat 1 to rotate freely until the seat magnet 24 becomes proximate once again to one or more base magnets 23. It should be appreciated that many types of magnets, including but not limited to electromagnets, may be used without departing from the scope of the present disclosure. Moreover, in some embodiments magnets are disposed only upon one of the seat 1 and the gliding top 11 whereas to opposite includes one or more ferromagnetic materials in place of the magnets shown herein.

In some embodiments, the multi-directional glider 100 enable the user is able to constraint the seat 1 in relation to the gliding base 10 at one or more predetermined orientations about the rotational axis of the rotatable coupler 15 and also allows for the user to select any other orientation which has not been predetermined. For example, some embodiments may include a detent mechanism configured to resist the rotation of the seat 1 about the z-axis and wherein the detent system comprises one or more predetermined orientations, e.g. eight orientations with a first being defined by the x-axis as defined herein and one additional orientation at each of the seven forty-five degree increments occurring along the full 360 degrees of rotation about the z-axis, and in addition to the detent system these embodiments may further comprise a detent override allowing for the user to constrain the orientation of the seat 1 at any other non-predetermined orientation, e.g. orientations which are not predefined by the detent system. Preferred embodiments comprise both a detent system allowing the user to lock the seat 1 in one or more popular predetermined orientations as well as a non-detent based constraint system to allow for maximum versatility. An example of such a detent system is disclosed in U.S. Pat. No. 6,810,780 to Ceroll et al., entitled "Miter Detent Override for a Sliding Compound Miter Saw", and fully incorporated by reference herein. Furthermore, preferably a user choose to operate the glider with all locking mechanisms opened such that seat freely rotates and glides simultaneously.

With particular reference to FIGS. 4-5, in some embodiments the multi-dimensional glider 100 the gliding top 11 further comprises rounded corners 21 (4 shown) in order to reduce the occurrence of pinching as the seat 1 is rotated in relation to the gliding top 11, e.g. as the seat is rotated about the z-axis. Referring back to FIG. 2, it should be appreciated that the rounded corners 21 are preferable in certain embodiments because, depending on the relative size of the gliding top 11 in relation to the seat 1, and more particularly the bottom element 3, a pinch-point may be created near the corners of the gliding top 11 as the seat is rotated; however, the addition of rounded corners 21 alleviates the pinch-point problem.

Figure 12:
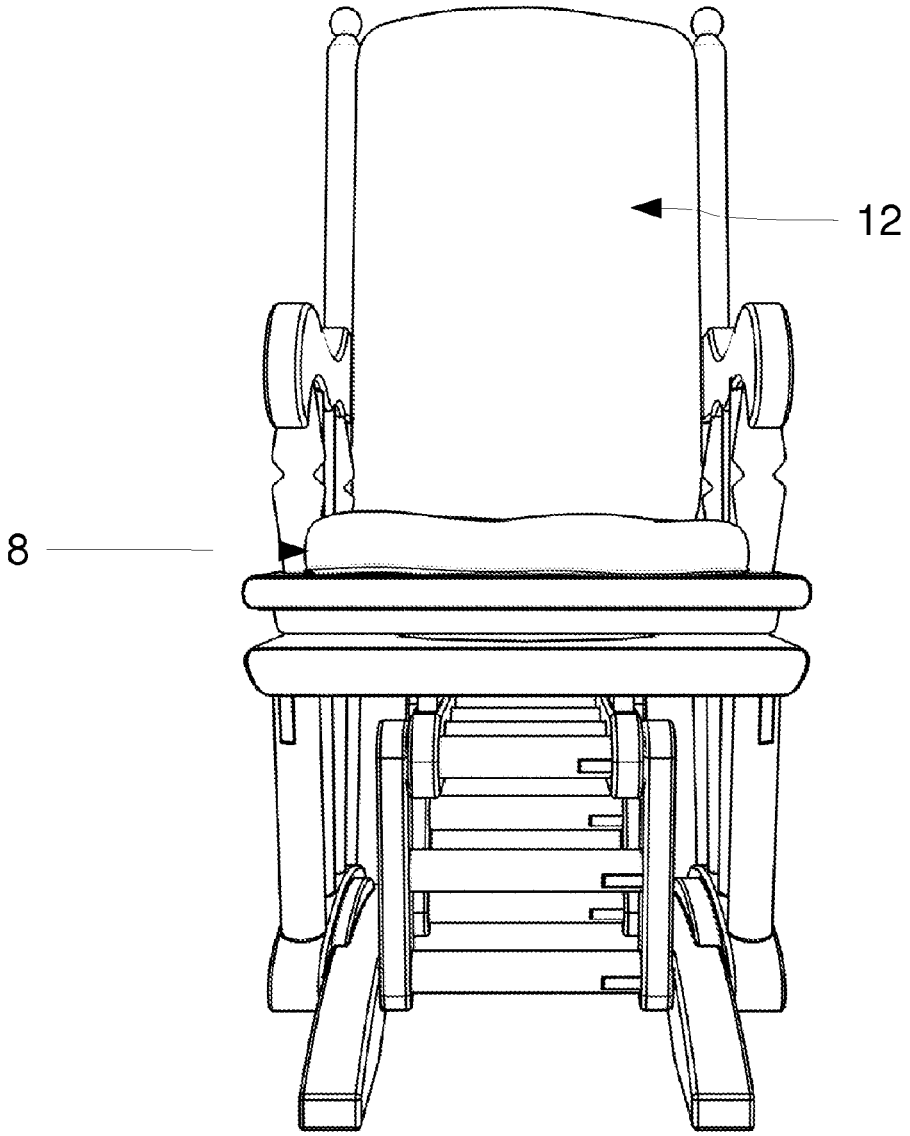
FIG. 12 shows a front view of a multi-directional glider with cushions thereon, in accordance with an embodiment of the present disclosure.

Referring now to FIG. 12, in some embodiments the multi-directional glider comprises one or more cushioning elements

8, 12. In particular, FIG. 12 illustrates an embodiment which comprises a back cushion 12 and a seat cushion 8.

Figure 13:
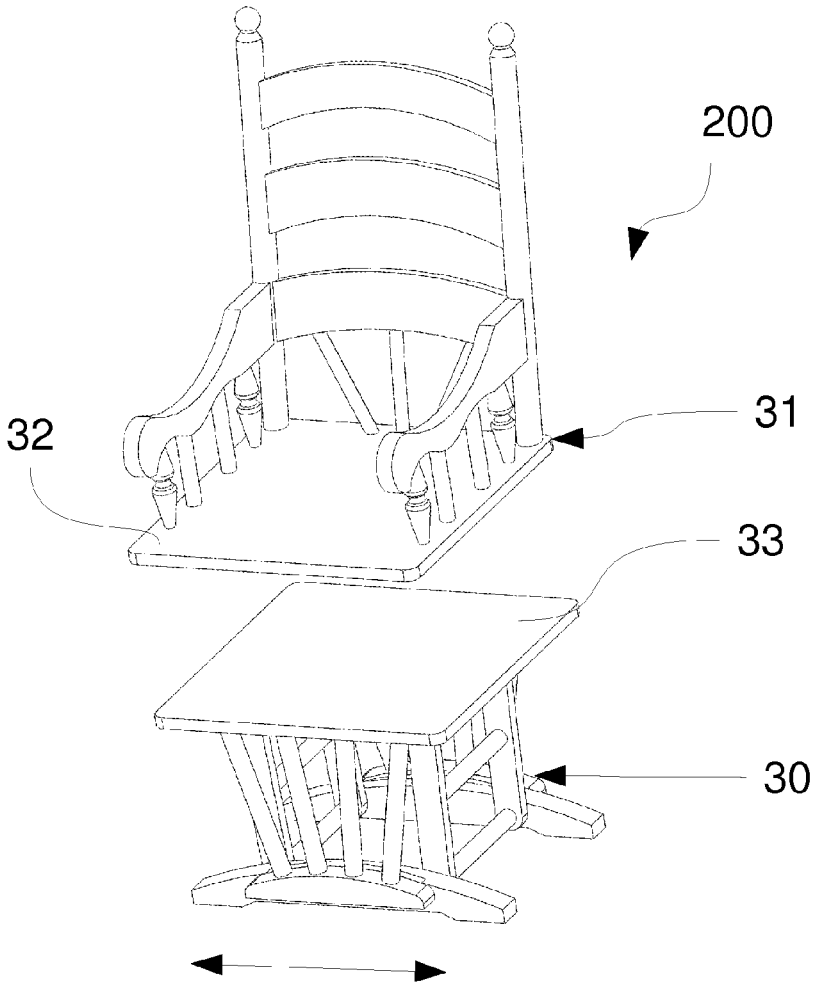
FIGS. 13-15 show various views of an embodiment of a side glider, in accordance with an embodiment of the present disclosure.
Figure 14:
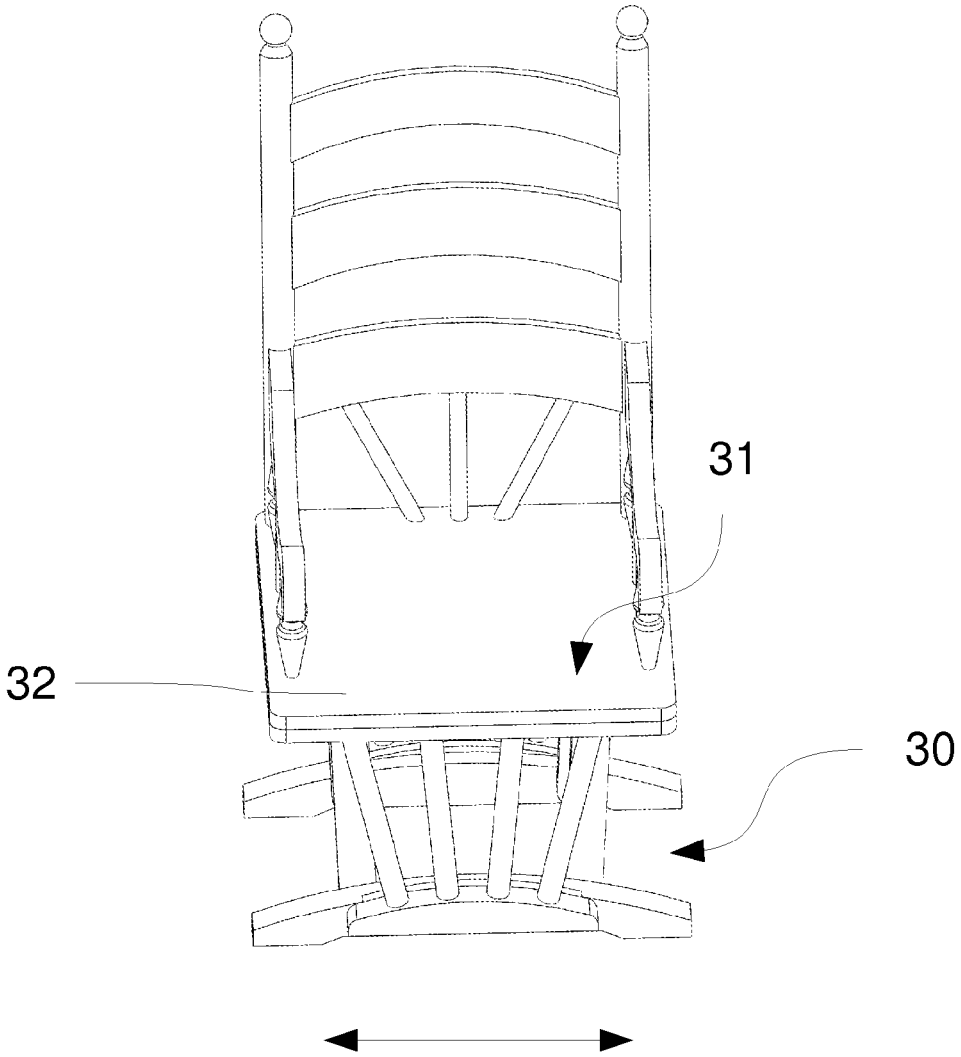
Figure 15:
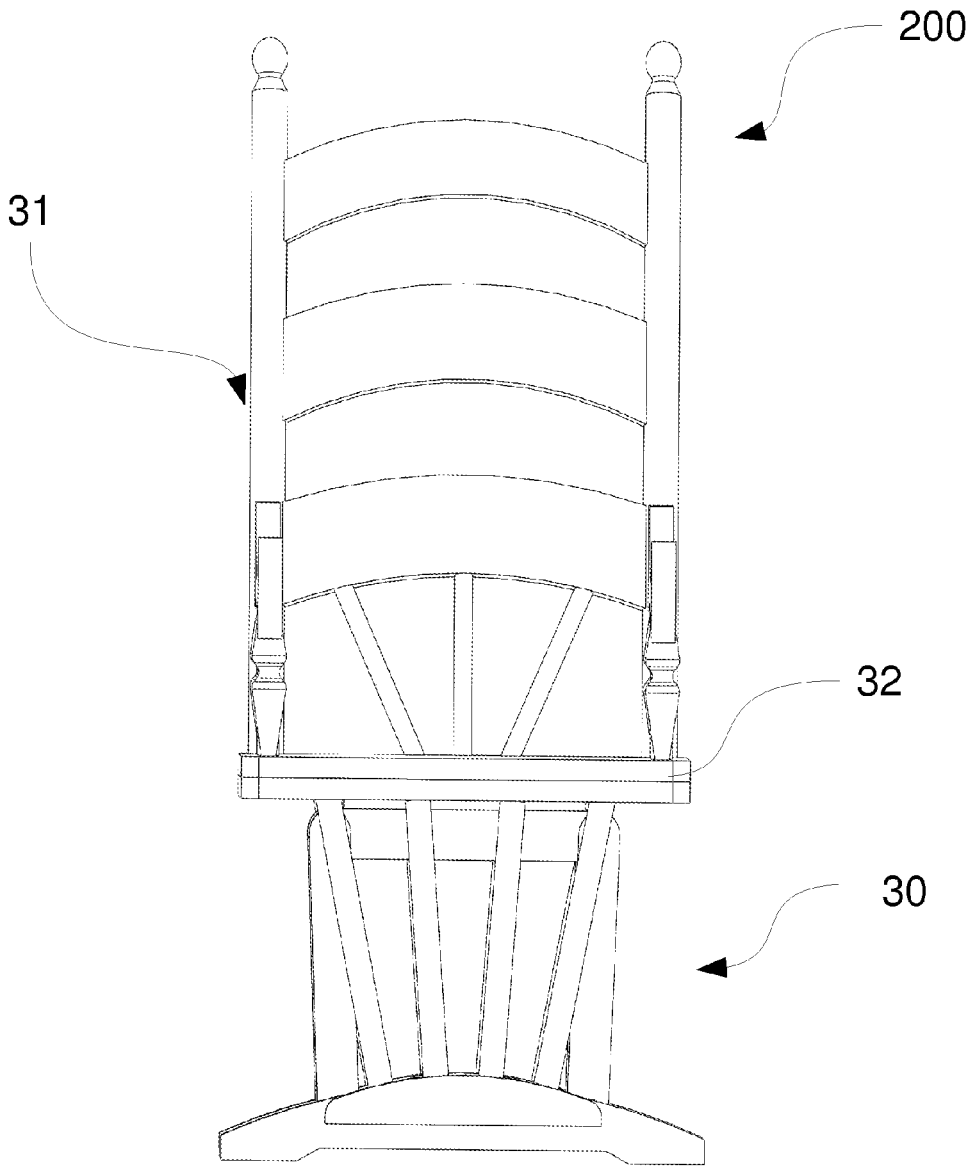

Referring now to FIGS. 13-15, various views of an embodiment of a side glider 200 are shown. In some embodiments the side glider 200 includes a gliding base 30 similar to gliding base 14 of the multi-directional glider 100 as well as a seat 31 similar to the seat 1 of multi-directional glider 100. However, unlike the multi-directional glider 100, the side glider 200 does not include a rotatable coupler connected seat 31 to gliding base 30. Instead a bottom element 32 of the seat 31 is non-rotatably coupled to the gliding base 30 and, more particularly, to a gliding top 33 of the gliding base 30. For example, in some embodiments the gliding top 33 and the bottom element 32 are glued to one another. In other embodiments, the gliding top 33 and the bottom element 32 are fastened to one another with one or more mechanical fasteners (not shown). It should be appreciated that it is not necessary for the gliding top 33 and the bottom element 32 to be separate pieces, e.g. a single piece can serve the purpose and functions of both the bottom element 32 of the seat 31 and the gliding top 33 of the gliding base 30. However, for ease of manufacturing it may be preferable for the gliding top 33 and the bottom element 32 of the seat to be separate pieces coupled together during manufacturing. As can be seen from the glide-path (indicated in each of FIGS. 13-14 by a double headed arrow) of the side glider 200, a person sitting in the seat 31 can cause the same to glide from side-to-side as opposed to fore-to-aft. In some embodiments, the side glider 200 does not provide for an exact side-to-side glide path, e.g. a glide path exactly 90 degree rotated from fore-to-aft; rather, any other glide path noticeably offset from a fore-to-aft path is within the scope the side glider 200.

While preferred and alternate embodiments have been illustrated and described herein, as noted above, many changes can be made without departing from the spirit and scope of the multi-directional glider. For example, although the predominant example used throughout this application and shown in the illustrations resembles a modern wooden framed glider, it is also within the scope of the multi-directional glider 100 to be configured to resemble a modern upholstered rocking or glider chair. Accordingly, the scope of the multi-directional glider is not limited by the disclosure of these preferred and alternate embodiments. Instead, the scope of the multi-directional glider should be determined entirely by reference to the claims.

What is claimed is:

1. A glider chair providing for a plurality of glide paths in relation to a seated persons orientation, comprising:

a glider base including a glider mechanism supporting a gliding top, the glider mechanism providing for generally linear motion of the gliding top along at least a segment of a first axis; and a seat including at least a bottom element and a backrest extending upwardly from the rear of the bottom element; the bottom element being rotatably coupled to the gliding top of the glider base by an upwardly extending flange which engages a circular track providing for rotation of the seat about a second axis;

at least one locking mechanism being affixed to one or more of the gliding top and the seat, the gliding mechanism being configured for constraining rotation of the seat about the second axis thereby constraining the orientation of the seat in relation to the first axis, wherein an orientation of the seat in relation to the first axis may be selectively modified by rotation of the seat about the second axis such that the seat may be rotated relative to the glider base for a generally linear movement along a plurality of glide paths angled relative to the first axis.

2. The glider chair of claim 1, wherein at least a part of the at least one locking mechanism is integral to the upwardly extending flange.

3. The glider chair of claim 1, wherein the at least one locking mechanism being affixed to one or more of the gliding top and the seat is configured for constraining the orientation of the seat in relation to the first axis at one or more predetermined orientations.

4. The glider chair of claim 3, wherein the at least one locking mechanism being affixed to one or more of the gliding top and the seat includes at least one detent for constraining the orientation of the seat in relation to the first axis at one or more predetermined orientations.

5. The glider chair of claim 3, wherein the at least one locking mechanism being affixed to one or more of the gliding top and the seat includes one or more magnets disposed upon at least one of the gliding top and the seat.

6. The glider chair of claim 1, wherein the seat comprises: a backrest extending upward from the bottom element; and a left armrest and a right armrest.

7. The glider chair of claim 1, wherein at least one of the glider base and the seat is at least partially upholstered.

8. The glider chair of claim 1, wherein the gliding top is generally quadrilateral and further comprises rounded corners.

9. The side glider chair of claim 1, wherein the seat further comprises a left armrest and a right armrest.

10. The side glider chair of claim 1, wherein at least one of the glider base and the seat is at least partially upholstered.

* * * * *